US006906636B1

(12) United States Patent
Kraml

(10) Patent No.: US 6,906,636 B1
(45) Date of Patent: Jun. 14, 2005

(54) USING PAGING OR SATELLITE PAGING TO TRIGGER REMOTE DEVICES

(75) Inventor: Mark H. Kraml, Flanders, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/245,101

(22) Filed: Jan. 21, 1999

(51) Int. Cl.[7] ..... G08B 5/22
(52) U.S. Cl. ..... 340/825.37; 340/7.1
(58) Field of Search ..... 340/825.37, 72, 340/7.1, 7.32, 7.33, 7.39, 7.23, 7.24, 5.74, 568.1, 571, 539, 426, 429, 7.37, 825.72, 5.79; 455/12.1; 379/198, 102.5; 307/10.2–10.5; 358/1.17; 713/191, 188

(56) References Cited

U.S. PATENT DOCUMENTS

| | | | | |
|---|---|---|---|---|
| 4,214,229 A | * | 7/1980 | Warner | 367/198 |
| 5,337,044 A | | 8/1994 | Folger et al. | |
| 5,588,038 A | | 12/1996 | Snyder | |
| 5,608,655 A | * | 3/1997 | Moughanni et al. | 340/7.1 |
| 5,748,084 A | * | 5/1998 | Isikoff | 340/568.1 |
| 5,892,432 A | * | 4/1999 | Skoog | 340/7.1 |
| 6,075,863 A | * | 6/2000 | Krishnan et al. | 713/191 |

FOREIGN PATENT DOCUMENTS

EP 0716553 A2 6/1996

* cited by examiner

*Primary Examiner*—Michael Horabik
*Assistant Examiner*—William Bangachon

(57) ABSTRACT

The existing paging infrastructure is used to send commands to operate remotely-located electronic or mechanical devices. A paging message containing one or more pre-set commands, trigger signals, or command strings is received by a paging receiver into an optional signal buffer which provides the received message to a message compare function. The message compare matches each component of the message to a set of one or more allowed commands and sends at least one signal or command that causes the action specified by the received message contents to take place at the target device. The command may be a signal for triggering an electronic or mechanical action, or may be a command that causes an operation to be performed in a software-controlled component of the target device. An alternate embodiment allows responses generated by the system and/or the target device to be forwarded back to the initiator via a two-way paging transceiver. The target device either has the capability of generating one or more signals or other messages in response to the commands received, or the system has the capability of sensing the state of the target device after receipt of the commands. Responses generated by the target device may be sent to the optional signal buffer or directly to the paging transceiver, or may be received and modified by a response generation function that is part of the system. Responses may be relayed either at the completion of the execution of all the received commands or after the execution of any of the commands in a multi-command sequence, providing feedback to the initiator as the command sequence is processed. The initiator may also receive an indication of the success or failure of the entire sequence of operations, or may receive data or other information produced or collected by the target device.

53 Claims, 3 Drawing Sheets

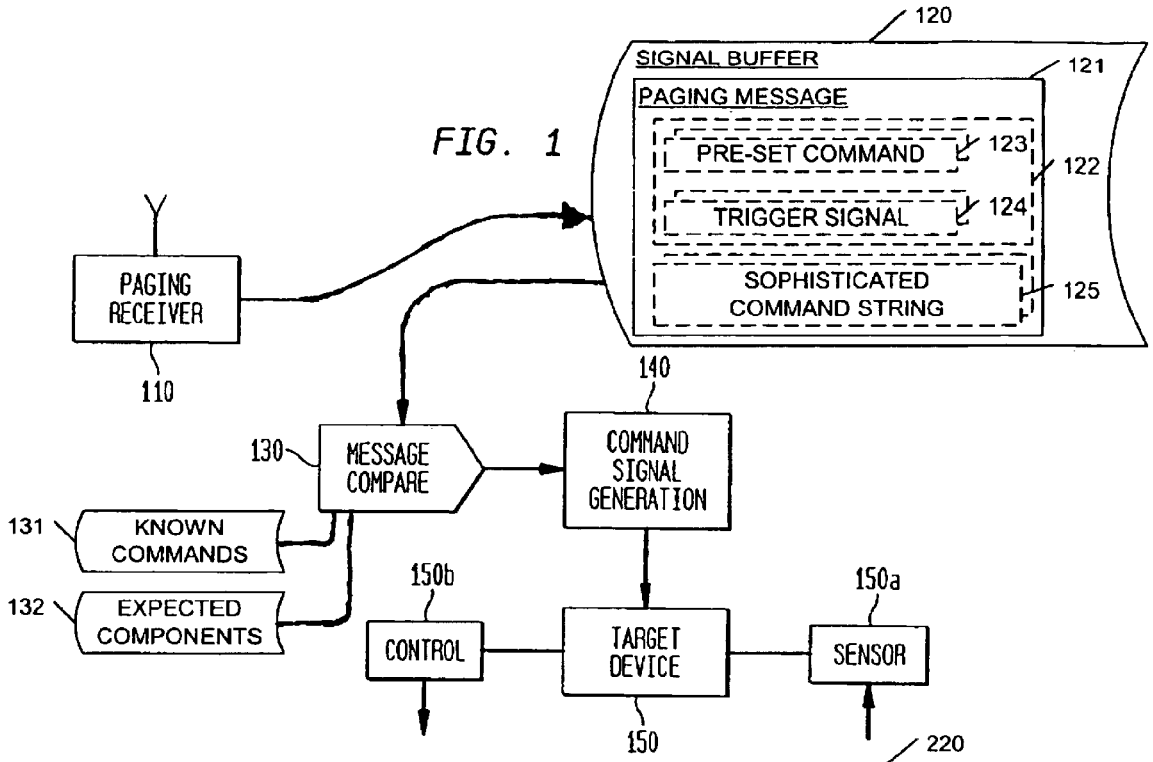
FIG. 1
120
SIGNAL BUFFER
121
PAGING MESSAGE
PRE-SET COMMAND
123
122
TRIGGER SIGNAL
124
SOPHISTICATED COMMAND STRING
125
PAGING RECEIVER
110
140
130
MESSAGE COMPARE
COMMAND SIGNAL GENERATION
131
KNOWN COMMANDS
132
EXPECTED COMPONENTS
150b
150a
CONTROL
TARGET DEVICE
SENSOR
150

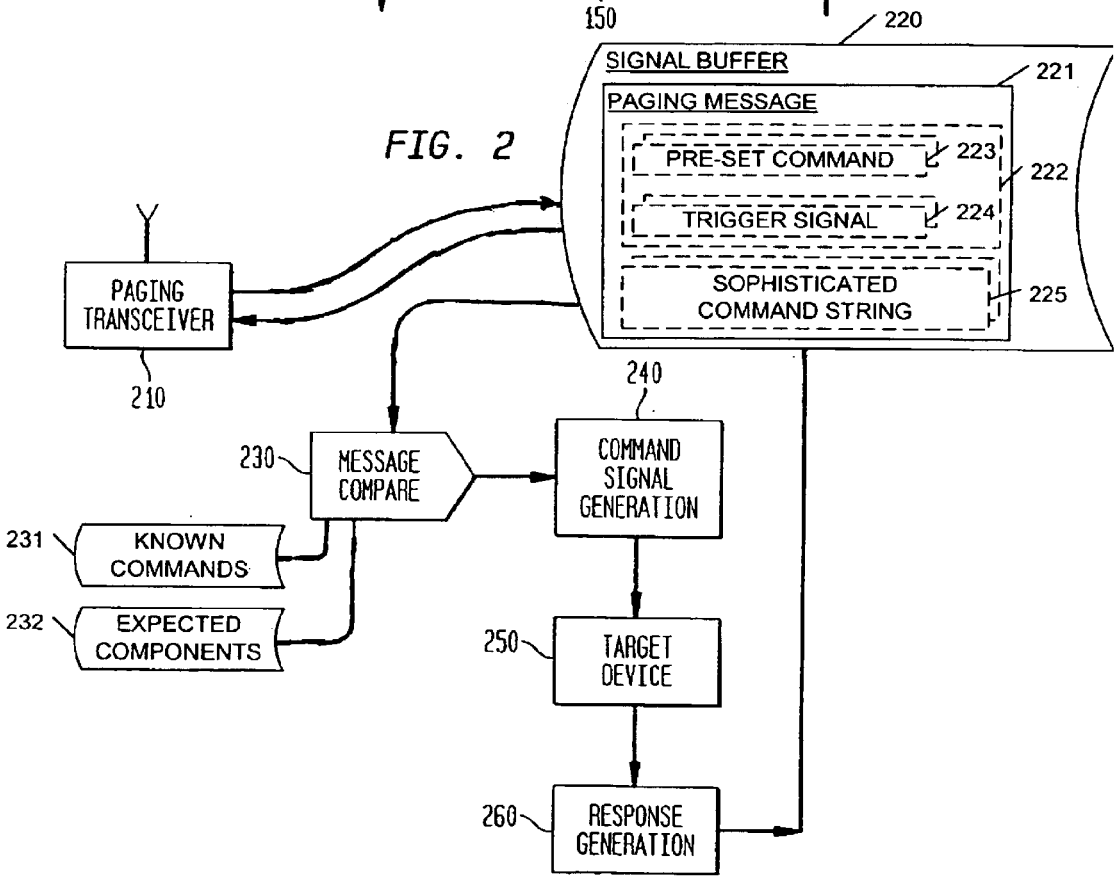
FIG. 2
220
SIGNAL BUFFER
221
PAGING MESSAGE
PRE-SET COMMAND
223
222
TRIGGER SIGNAL
224
SOPHISTICATED COMMAND STRING
225
PAGING TRANSCEIVER
210
240
230
MESSAGE COMPARE
COMMAND SIGNAL GENERATION
231
KNOWN COMMANDS
232
EXPECTED COMPONENTS
250
TARGET DEVICE
260
RESPONSE GENERATION

USING PAGING OR SATELLITE PAGING TO TRIGGER REMOTE DEVICES

FIELD OF THE INVENTION

The present invention relates to remote operation of electronic or mechanical devices and, in particular, to a method for using paging or satellite paging to send trigger signals to remote devices.

BACKGROUND OF THE INVENTION

Currently, great difficulties arise in communicating with electronic or mechanical equipment which is located remotely at a site that is inaccessible by anything other than wireless communications or a physical visit. Typically, such equipment can only be reset or otherwise modified in its operation via a physical visit from a technician or other service personnel. For example, when a cellular communications site located on an off-shore drilling platform hangs, the platform must be visited by boat in order that a button may be pressed to reset the cell site.

Accordingly, a primary object of the present invention is to provide a way to remotely operate electronic or mechanical devices via wireless communications. In particular, an object of the present invention is to use the existing paging or satellite paging infrastructure to send trigger signals and/or commands to remote devices.

SUMMARY OF THE INVENTION

The present invention uses an existing paging or satellite paging system to send trigger signals or commands to operate remotely-located electronic or mechanical devices. Either numeric-only or alphanumeric paging systems may be employed. In one embodiment, the invention has a paging receiver capable of receiving paging or satellite paging signals. One or more PINs may be employed for security purposes. The paging message typically contains one or more pre-set commands, trigger signals, or command strings.

The paging message is received by the paging receiver into an optional signal buffer which provides the received message to a message compare function. The message compare function matches each component of the received paging message to a set of one or more known commands and sends at least one signal or command, as determined by the result of the matching process, to the command signal generator. The command signal generator is prompted by each signal or command received from the message compare function to send out a signal or command that causes the desired action to take place at or upon the target device. This signal or command could be a trigger signal for triggering an electronic or mechanical action, or could be a computer command that causes an operation to be performed in a software-controlled component of the target device. In an alternate embodiment, the command signal generator is not present, with one or more command or trigger signal being directly generated by the message compare function as the result of the comparison.

An alternate embodiment of the invention allows responses to be generated by the system and/or to be forwarded from the target device back to the initiating party. In this embodiment, the paging message is received by a two-way paging transceiver into an optional signal buffer. The received message is provided to the message compare function, where it is compared with a set of one or more known commands. The message compare function sends at least one signal or command determined by the result of the matching process to either the optional command signal generator or the target device. The command signal generator, if present, is caused by each signal or command received from the message compare function to send out a signal or command that causes the desired action to take place at the target device.

In this embodiment, either the target device has the capability of generating one or more signals or other messages in response to the commands received, or the system has the capability of sensing the state of the target device after receipt of the commands. If there is a response generation function that is integral to the target device, the target device provides one or more responses to the received commands. These responses may be sent to the optional signal buffer or directly to the paging transceiver if the signal buffer is not present, or may be received and modified by a response generation function that is part of the system of the invention. Alternatively, the response generation function may itself generate one or more responses based on a sensing of the state of the target device after execution of the received commands.

Responses are then relayed from the optional signal buffer or directly from the target device or response generation function back to the initiator via the paging transceiver. Responses may be relayed either at the completion of the execution of all the received commands or after the execution of each, or certain specific ones, of the commands in a multi-command sequence, providing feedback to the initiator as the command sequence is processed. Finally, the initiator may receive an indication of the success or failure of the entire sequence of operations, or, in a more sophisticated system may receive data or other information produced or collected by the target device.

BRIEF DESCRIPTION OF THE DRAWINGS

FIG. 1 is a block diagram of an embodiment of a system for remote operation of one or more devices according to the present invention;

FIG. 2 is a block diagram of an embodiment of a system for remote operation of one or more devices, including transmission of response messages, according to the present invention;

DETAILED DESCRIPTION

Figure 3:
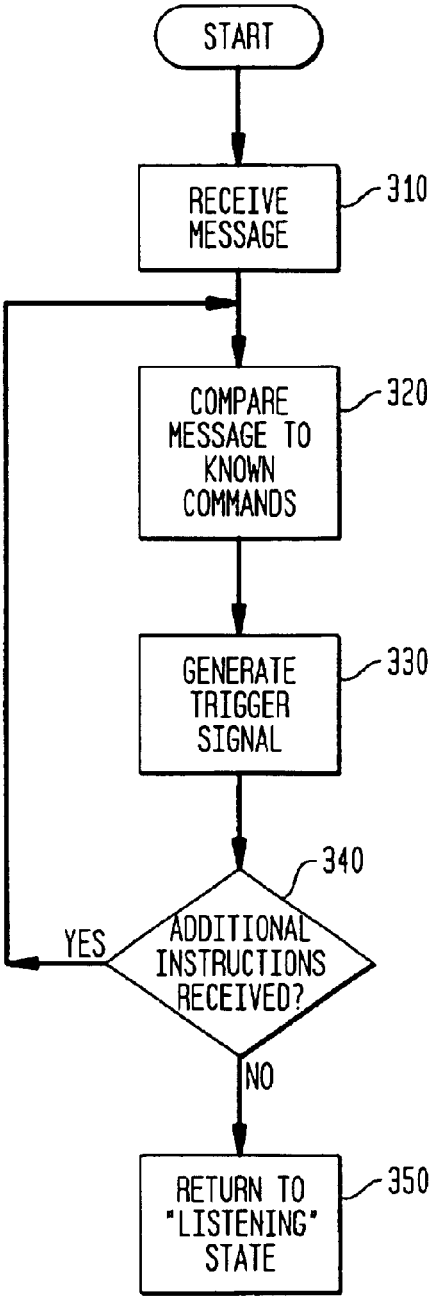
FIG. 3 illustrates the remote operation of one or more devices according to one embodiment of the present invention.

The present invention uses an existing paging or satellite paging system to send trigger signals or commands to operate remotely-located electronic or mechanical devices. As shown in the block diagram in FIG. 1, in one embodiment the present invention has a paging receiver 110 capable of receiving paging or satellite paging signals. Examples of such devices include, but are not limited to, one way paging devices manufactured by Motorola of Schaumburg, Ill., such as the FLEX (™) one-way pager product line. Such a one-way pager typically comprises an RF receiver including an analog to digital converter for forwarding data via a decoder to a microprocessor and includes a user interface for forwarding the received data. It is anticipated that one or more PINs would be required to be sent in order to operate the device, although this is of course optional and may be varied according to the security and ease of-access needs of a particular application of the invention. If one or more PINs are used, the system can be set to change the PIN each time the remote access capability is used in order to provide an extra layer of security. Although any of the methods known in the art for implementing such a feature would be suitable, it is envisioned that one implementation would function much the same way as many newer garage door openers, which allow the access code to be randomly changed each time the garage door is opened.

The received paging message 121 typically will contain either one or more pre-set commands 123 or trigger signals 124, or will contain at least one more sophisticated command string 125. Either numeric-only or alphanumeric paging systems may be employed, with the latter being particularly useful for an application utilizing the command string approach. The message may contain any number of components, likely including identifying and/or handshaking information as well as other security-required parameters in addition to the optional PIN already described. The duration that the message continues, or that particular components of the message continue, may also have an information-containing function. In particular, it is anticipated that a minimum duration for the received message would be specified in order to ensure that the system is not accidentally activated by random noise or by interrupted messages that may not contain all the necessary information for completion of the task being initiated. It is also anticipated that for some commands a minimum duration that an action is to be performed at the target device 150 would be included as part of the command, also to ensure that the operation is not unintentionally triggered due to noise or environmental conditions.

In accordance with one embodiment of the present invention, an example data format and contents for activating a single control target contains the following: deviceId/command/optionalParameter1/optionalParameterN/unlockKey/checkDigits. In this example, "deviceId" represents a unique identifier associated with the device to be triggered; "command" represents a command code representing a possible command action to execute; and the optional parameters may represent which of a plurality of output controls to use to perform the desired action when a number of output controls are provided by the device to be triggered. "UnlockKey" represents a secret number which may be variable or remain stored in memory until changed by command. The "unlockKey" authenticates the source of the message so that it may be assured that the deviceId is not being actuated by another than the true source. Finally, "checkDigits" is a code generated from the entire contents of the message to insure that all the data bits in the command have been received without error. Any appropriate coding may be used from simple parity to more complicated checksum and/or error correction coding. An error detected may inhibit execution of the command. In a two way system, retransmittal of the command may be requested.

The "command" may be SET, to request the output deviceId to be changed to a SET state, CLR, to request the output deviceId to be changed to the CLEAR (or reset) state; TSC, to toggle the deviceId output from the current state to the SET state and then to the CLEAR state, and TCS, which toggles the deviceId output from the current state to the CLEAR state and then to the SET state. These TCS and TSC commands may be preset with a default time interval to delay for the transition from one state to the next. The time value of the delay interval may also be set by the optionalParameter value to a variable value in stead of a default value. The optionalParameter field may also be used as a count for a counter to count a number of attempts to set or clear or perform another command. Moreover, the repeat count command can be augmented with the specification of a delay interval between repeat actions of the command.

It is also possible to rearrange the message suggested above or provide more or less information in a message. It is also possible that many commands may be contained in a single message. For this purpose, the commands may be delimited by length fields or command delimiter code within the message body. The command may also be delimited to multiple commands by predefining positions for the commands within the message itself or a particular command may signal the requirement for further commands within the same message. The simple message provided above should not be considered as limiting and other message formats and commands contained therein may come to mind depending on the particular device to be triggered or the like.

An entire program may be transmitted to a device via a one way pager 110 for checking the status of a target and make choices based on self contained logic within the message. For example, a JAVA applet may be transmitted with a JAVA Virtual Machine implemented in the target receiver or target device where the Virtual Machine is augmented with a library of functions to access external controls and sensors of the device. Such an applet upon receipt may perform extensive data collection and perform advanced corrective actions.

In the embodiment of FIG. 1, the paging message 121 is received by the paging receiver 110 into a signal buffer 120, which provides the received message 121 to a message compare function 130. While the signal buffer 120 is optional, in general it is a preferred part of the implementation as it ensures that the entire paging message 121 has been received before entry into the message compare function 130. The message compare function can be implemented in hardware or software. It is anticipated that the message compare function 130 would typically be implemented either in hardware/firmware or in software if the received paging message 121 contains a simple trigger signal 124, but would most likely be implemented in software if the received paging message is in the form of a command string 125 or has multiple components.

In the embodiment of FIG. 1, the message compare function 130 matches each component of the received paging message 121 to a set of one or more known commands 131 or other expected components 132 of the message and sends at least one signal or command determined by the result of the matching process to the command signal generator 140. The command signal generator 140 is prompted by each signal or command received from the message compare function 130 to send out a signal or command that causes the desired action to take place at the target device 150. This could be a trigger signal for triggering an electronic or mechanical action, or could be a computer command that causes an operation to be performed in a software-controlled component of the target device 150. Each command sent from the command signal generator 140 would cause a separate action or sequence of actions to be performed at or on the target device 150. The command signal generator 140 is implemented in hardware or software depending on the type of message/signal received from the message compare function 130 and the type of output signal required to initiate the desired activity at the target device 150. Sensors (one sensor 150*a* shown) or external controls (one control 150*b* shown) may be associated with the target device 150 which may be accessed for performing a myriad of functions such as fire control, energy management, security control and the like. For some of these functions, it may be readily apparent that a two way application of the present invention may be advantageous over a one way paging for status monitoring and reporting.

As previously discussed, the command may include a minimum duration of action component (e.g. that a voltage is to be applied for a minimum of 30 seconds) in order to ensure that a particular action is only performed in response to receipt of a bonafide command. In such a case, the target device would be set to only respond to the trigger if the trigger lasted at least a specified duration. Similarly, a particular duration may be specified between the performance of the individual components of a sequence of operations or commands.

For example, in a simple mechanical system the command signal generator 140 can produce a high or low voltage for driving a solenoid connected to an arm that pushes a simple reset button on the target device 150. For an electronic system, a trigger pulse can be sent by the command signal generator 140 to change the state of a particular flip-flop and thereby reset the trigger device 150. For a computer-controlled target device 150, the command signal generator 140 can generate a serial command string that causes the device 150 to be reset. While the examples given are for specific methods of performing a reset operation on or at the target device, it is clear that other operations might be performed instead of, or in addition to, a reset operation, and these are contemplated by the inventor as being within the scope of the invention. It is equally obvious that other specific methods of performing various mechanical, electrical, or computer-driven operations would be suitable, and these are also contemplated by the inventor as being within the scope of the invention.

In an alternate embodiment, the command signal generator 140 is not present, with one or more commands or trigger signals being directly generated by the message compare function 130 as the result of the comparison. In particular, this embodiment is useful when the target device 150 has a software-controlled component that is activated by receipt of a particular command string. In such a situation, the message produced as a result of the comparison performed by the message compare function 130 is one of the set of acceptable command strings for causing actions by the software-controlled component of the target device 150, and the message is received directly by the target device 150 from the message compare 130.

An alternate embodiment of the invention which allows responses to be generated by the system and/or to be forwarded from the target device is shown as a block diagram in FIG. 2. In the embodiment of FIG. 2, the paging message 221 is received by a two-way paging transceiver 210 into an optional signal buffer 220. Examples of suitable transceiver devices include, but are not limited to, those manufactured by Motorola such as the TANGO (™) two-way pager which employs a ReFLEX (™) messaging protocol. As in the embodiment of FIG. 1, the received message 221 is provided to the message compare function 230, which compares the message to a set of one or more known commands 231 and/or other components 232 and sends at least one signal or command determined by the result of the matching process to the optional command signal generator 240. The command signal generator 240, if present, is prompted by each signal or command received from the message compare function 230 to send out a signal or command that causes the desired action to take place at the target device 250.

In this embodiment, either the target device 250 has the capability of generating one or more signals or other messages in response to the commands received, or the system of the invention has the capability of sensing the state of the target device 250 after receipt of the commands. If there is a response generation function that is integral to the target device 250, the target device provides one or more responses to the received commands. These responses may be either sent directly to the optional signal buffer 220, or to the paging transceiver 210 if the signal buffer 220 is not present, or alternatively may be received and modified by a response generation function 260 that is part of the system of the invention. Alternatively, the response generation function 260 may itself generate one or more responses based on a sensing of the state of the target device 250 after execution of the received commands.

The response generation function 260 may be implemented in hardware and/or software, depending on the type of input that will be received from the target device and whether or not sensing of a response or state data is required. It is anticipated that in most applications the response generation function will contain at least some software components in order to properly construct the paging message that will be relayed back to the initiator.

Responses are next relayed from the optional signal buffer 220 or directly from the target device 250 or response generation function 260 back to the initiator via paging transceiver 210. An optional trigger signal may also be employed to start the transmission from transceiver 210 if desired. Responses may be relayed either at the completion of the execution of all the received commands or after the execution of each, or certain specific ones, of the commands in a multi-command sequence.

The response generation capability of the system can be used for a number of purposes. At the outset, a challenge system may be implemented for security purposes. In this mode, the initial paging message serves to establish communications with the target device, which responds with a security challenge that must be met via a second paging message. Later in the session, the responses may provide feedback to the initiator as the command sequence is processed, allowing the initiator to follow the progress of the operations and the success or failure of one or more of the specific operations being performed. Finally, the initiator may receive an indication of the success or failure of the entire sequence of operations, or, in a more sophisticated system, may receive a status indication, data, or other information produced or collected by the target device.

An example of a simple application of the invention might be the reseting of a hung cellular communications site, where the reset cell site would transmit back a specific code indicating that it was back on line at the end of an electromechanical operation involving pushing a reset button. On the other hand, a highly sophisticated application might be the collection of weather data from a remote sensing site. In this case, the multiple responses sent back might be quite extensive and would be expected to include such variables as temperature, wind, or other climate data as collected at specific time intervals.

The operation of an embodiment of the system of FIG. 1 that employs trigger signals is depicted by the flowchart of FIG. 3. The paging message from the initiator is received 310 at the paging receiver that is co-located with the remote target device. After optional buffering, the received paging message is compared 320 to a set of known, or allowed, commands. Based on the result of the comparison step 320, a specific trigger signal is generated 330 that causes an action to be taken at, or upon, the target device. If the received paging message has more than one component, or if additional such messages are received 340, the next component or message is then compared 320 to the set of known commands, leading to the generation of another trigger signal 330, etc. Otherwise, the system returns to the "listening" state 350 in which it is awaiting another paging message.

Figure 4:
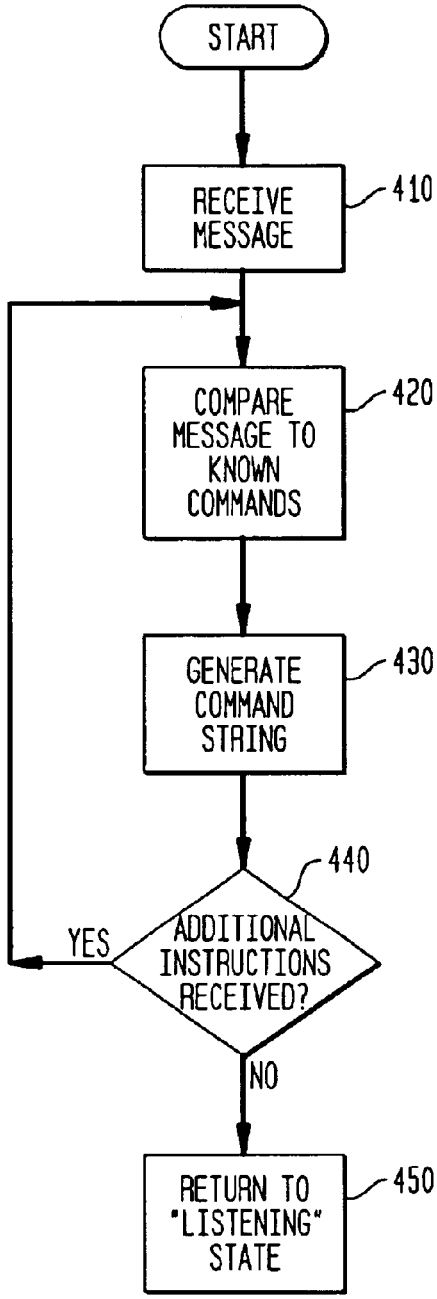
FIG. 4 illustrates the remote operation of one or more devices according to an alternate embodiment of the present invention.

The operation of an embodiment of the system of FIG. 1 that employs command strings is depicted in the flowchart of FIG. 4. In this embodiment, the paging message from the initiator is again received 410 at the paging receiver that is co-located with the remote target device. After optional buffering, the received paging message is compared 420 to a set of known, or allowed, commands. Based on the result of the comparison step 420, a specific command string, or set of command strings, is generated 430 that causes an action to be taken by the target device. If the received paging message has more than one component, or if additional such messages are received 440, the next component or message is then compared 420 to the set of known commands for generation of additional command strings 430. Otherwise, the system returns to the "listening" state 450 in which it is awaiting another paging message.

Figure 5:
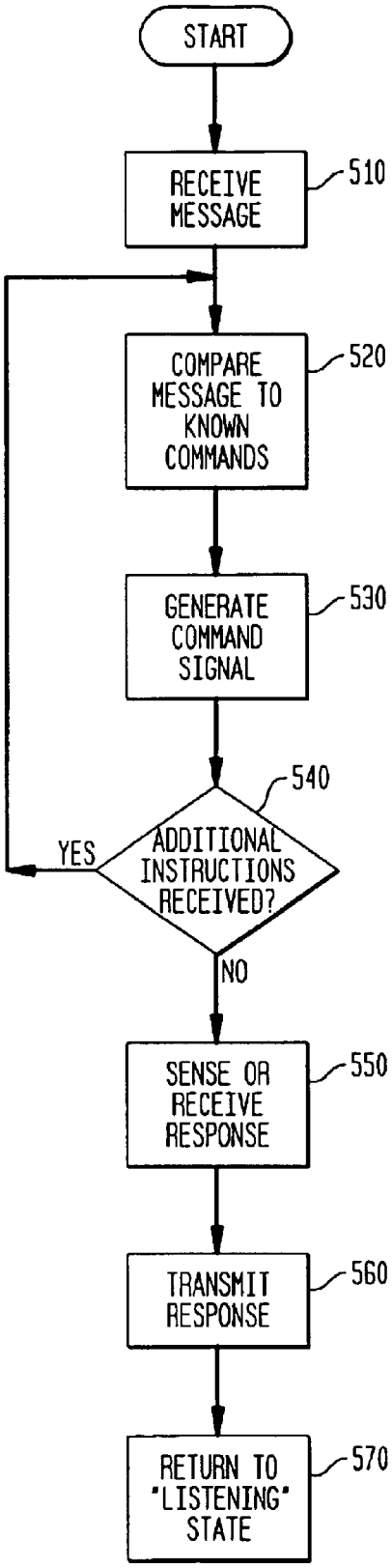
FIG. 5 illustrates the remote operation of one or more devices, including transmission of at least one response message, according to an embodiment of the present invention.

The operation of an embodiment of the system of FIG. 2 is depicted in the flowchart of FIG. 5. In this embodiment, the paging message from the initiator is received 510 at a two-way paging transceiver that is co-located with the remote target device. After optional buffering, the received paging message is compared 520 to a set of known, or allowed, commands. Based on the result of the comparison step 520, a command signal, either a trigger signal or a command string, is generated 530 and causes an action to be taken at, upon, or by the target device. If the received paging message has more than one component, or if additional such messages are received 540, the next component or message is then compared 520 to the set of known commands for generation of additional command signals 530. When all the components and/or messages have been received 510, compared 520, and acted upon 530, the system then senses or receives 550 the response of or from the target device and transmits 560 the response back to the initiator via the two-way paging transceiver. Finally, the system returns to the "listening" state 570 in which it is awaiting another paging message.

Figure 6:
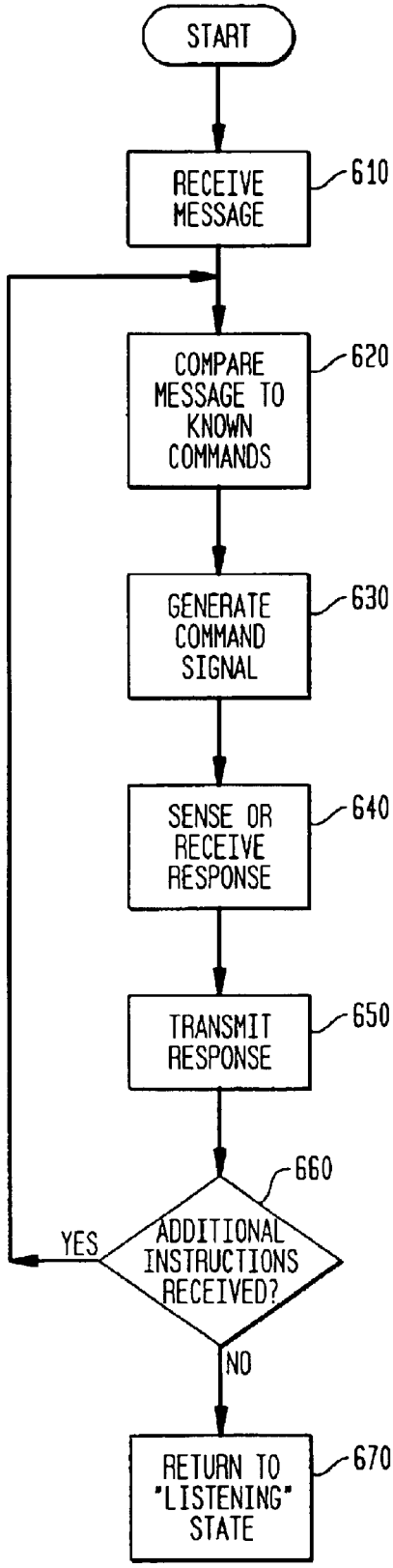
FIG. 6 illustrates the remote operation of one or more devices, including transmission of at least one response message, according to another embodiment of the present invention.

The operation of an alternate embodiment of the system of FIG. 2 is depicted in the flowchart of FIG. 6. In this embodiment, the paging message from the initiator is again received 610 at a two-way paging transceiver that is co-located with the remote target device. After optional buffering, the received paging message is compared 620 to a set of known, or allowed, commands. Based on the result of the comparison step 620, a command signal, either a trigger signal or a command string, is generated 630 and causes an action to be taken at, upon, or by the target device. The system then senses or receives 640 the response or responses of or from the target device and transmits 650 the response(s) back to the initiator via the two-way paging transceiver. If the received paging message has more than one component, or if additional such messages are received 660, the next component or message is then compared 620 to the set of known commands for generation of additional command signals 630, followed by sensing or receiving 640 of the response(s) of the target device and transmission 650 of the response(s) back to the initiator. Finally, when all components or messages have been received 610, compared 620, acted upon 630, and responded to 650, the system returns to the "listening" state 670 in which it is awaiting another paging message.

The specific embodiments described are clearly illustrations only, and any of the known means for transmitting and receiving paging or satellite paging messages, as well as for causing actions to be taken upon, at, or by, a remotely located device are clearly contemplated by the inventor and within the scope of the invention. What has been described, therefore, is merely illustrative of the application of the principles of the present invention. Other arrangements, methods, modifications and substitutions by one of ordinary skill in the art are also considered to be within the scope of the present invention, which is not to be limited except by the claims which follow.

What is claimed is:

1. A system for operation of a remotely located computer-controlled device, comprising:

receiver means for receiving at least one paging message, each paging message including content data, said receiver means co-located with said remotely located computer-controlled device;

means for comparing the content data of each said at least one paging message to a set of allowed commands; and means for sending at least one specific command to said remotely located computer-controlled device, each specific command determined as a result of the comparing of the content data of each said at least one paging message to the set of allowed commands, wherein the content data includes a program, wherein each specific command causes said remotely located computer-controlled device to perform at least two actions, and wherein one of said at least one specific command sent to said remotely located computer-controlled device includes the program.

2. The system of claim 1, further comprising buffer means for receiving said at least one paging message from said receiver means.

3. The system of claim 1, wherein said means for sending further comprises command generation means for constructing each specific command to be forwarded to said remotely located computer-controlled device.

4. The system of claim 2, wherein said means for sending further comprises command generation means for constructing each specific command to be forwarded to said remotely located computer-controlled device.

5. The system of claim 1, wherein said specific command is a trigger signal, or a command string.

6. The system of claim 4, wherein said specific command is a trigger signal, or a command string.

7. The system of claim 1, wherein the program is a Java Applet.

8. The system of claim 1, wherein the content data includes at least two allowed commands from the set of allowed commands.

9. The system of claim 4, wherein the content data includes at least two allowed commands from the set of allowed commands.

10. The system of claim 1, further comprising response means for sending at least one response paging message.

11. The system of claim 10, further comprising buffer means for receiving said at least one paging message from said receiver means.

12. The system of claim 10, wherein said means for sending further comprises command generation means for constructing each specific command to be forwarded to said remotely located computer-controlled device.

13. The system of claim 11, wherein said means for sending further comprises command generation means for constructing each specific command to be forwarded to said remotely located computer-controlled device.

14. The system of claim 10, wherein said specific command is a trigger signal, or a command string.

15. The system of claim 13, wherein said specific command is a trigger signal, or a command string.

16. The system of claim 10, wherein the program is a Java Applet.

17. The system of claim 10, wherein the content data includes at least two allowed commands from the set of allowed commands.

18. The system of claim 13, wherein the content data includes at least two allowed commands from the set of allowed commands.

19. The system of claim 10, wherein said response means includes a response generator means for creating each response paging message.

20. The system of claim 19, wherein said means for creating each response paging message includes sensing means for determining a state of said remotely located computer-controlled device.

21. The system of claim 19, wherein said means for creating each response paging message includes response receiving means for receiving a response message from said remotely located computer-controlled device.

22. The system of claim 10, wherein said response paging message includes a security challenge message.

23. The system of claim 10, wherein said response paging message includes a success or failure indication following execution of each specific command.

24. The system of claim 10, wherein said response paging message includes a status indication for said remotely located computer-controlled device.

25. The system of claim 10, wherein said response paging message includes data collected by or from said remotely located computer-controlled device.

26. A method for operation of a remotely located computer-controlled device, comprising:

receiving at least one paging message, each paging message including content data, on a receiver means co-located with said remotely located computer-controlled device;

comparing the content data of each said at least one paging message to a set of allowed commands; and sending at least one specific command to said remotely located computer-controlled device, each specific command determined as a result of the comparing of the content data of each said at least one paging message to the set of allowed commands, wherein the content data includes a program, wherein each specific command causes said remotely located computer-controlled device to perform at least two actions, and wherein one of said at least one specific command sent to said remotely located computer-controlled device includes the program.

27. The method of claim 26, further comprising buffering said at least one paging message after it arrives on the receiver means.

28. The method of claim 26, further comprising formulating each specific command as a result of the comparing of the content data.

29. The method of claim 27, further comprising constructing each specific command as a result of the comparing of the content data.

30. The method of claim 26, wherein said specific command is a trigger signal, or a command string.

31. The method of claim 29, wherein said specific command is a trigger signal, or a command string.

32. The method of claim 26, wherein the program is a Java Applet.

33. The method of claim 26, wherein the content data includes at least two allowed commands from the set of allowed commands and the method performs the sending of each specific command for each match found as a result of the comparing of the content data.

34. The method of claim 29, wherein the content data includes at least two allowed commands from the set of allowed commands and the method performs the sending of each specific command for each match found as a result of the comparing of the content data.

35. The method of claim 26, further comprising sending at least one response paging message.

36. The method of claim 35, further comprising buffering said at least one paging message after it arrives on the receiver means.

37. The method of claim 35, further comprising formulating each specific command as a result of the comparing of the content data.

38. The method of claim 36, further comprising constructing each specific command as a result of the comparing of the content data.

39. The method of claim 35, wherein said specific command is a trigger signal, or a command string.

40. The method of claim 38, wherein said specific command is a trigger signal, or a command string.

41. The method of claim 35, wherein the program is a Java Applet.

42. The method of claim 35, wherein the content data includes at least two allowed commands from the set of allowed commands and the method performs the sending of each specific command for each match found as a result of the comparing of the content data.

43. The method of claim 38, wherein the content data includes at least two allowed commands from the set of allowed commands and the method performs the sending of each specific command for each match found as a result of the comparing of the content data.

44. The method of claim 35, wherein said step of sending a response paging method further includes creating each response paging message.

45. The method of claim 44, wherein said step of creating each response paging message includes sensing a state of said remotely located computer-controlled device.

46. The method of claim 44, wherein said step of creating each response paging message includes receiving a response message from said remotely located computer-controlled device.

47. The method of claim 35, wherein each response paging message includes a security challenge message.

48. The method of claim 35, wherein each response paging message includes a success or failure indication following execution of each specific command.

49. The method of claim 35, wherein each response paging message includes a status indication for said remotely located computer-controlled device.

50. The method of claim 35, wherein each response paging message includes data collected by or from said remotely located computer-controlled device.

51. A system for operating a remotely located computer-controlled device, the remotely located computer-controlled device including a sensor and a control, comprising:

a transceiver for receiving at least one received paging message and transmitting at least one transmitted paging message, the transceiver co-located with said remotely located computer-controlled device;

a comparator for comparing content data of each received paging message to a set of allowed components;

a command generator for generating at least one command to the control, each command determined as a result of the comparing of the content data of each received paging message to the set of allowed components, wherein the sensor records a status of the sensor after the generating of said at least one command and reports the status to the transceiver for inclusion in said at least one transmitted paging message, and wherein the content data includes a program, wherein each command causes said remotely located computer-controlled device to perform at least two actions, and wherein one of said at least one command generated by the command generator includes the program.

52. The system of claim 51, wherein a duration of time between the sensor recording the status and the sensor reporting the status is a variable component of each received paging message.

53. The system of claim 51, wherein a duration of time between the sensor recording the status and the sensor reporting the status is a predetermined minimum for performance of each command by said remotely located computer-controlled device.

* * * * *